US005634642A

United States Patent [19]

Grandolfo

[11] Patent Number: 5,634,642

[45] Date of Patent: Jun. 3, 1997

[54] WATER DUMPING GAME WITH ADJUSTABLE TARGET

[76] Inventor: Giustino Grandolfo, 2879 Coddington Ave., Bronx, N.Y. 10461

[21] Appl. No.: 674,253

[22] Filed: Jul. 1, 1996

[51] Int. Cl.[6] ..... A63B 63/00

[52] U.S. Cl. ..... 273/384; 273/374

[58] Field of Search ..... 273/384, 385, 273/374, 383

[56] References Cited

U.S. PATENT DOCUMENTS

| | | | |
|---|---|---|---|
| 988,334 | 4/1911 | Hammett | 273/385 |
| 1,131,549 | 3/1915 | Ellis | 273/374 |
| 1,593,267 | 7/1926 | Myre | 273/384 |
| 1,644,890 | 10/1927 | Myre | 273/384 |
| 1,869,388 | 8/1932 | Peter | 273/384 |
| 4,093,228 | 6/1978 | Pierce | 273/384 |
| 4,702,480 | 10/1987 | Popeski et al. | 273/384 |
| 5,482,292 | 1/1996 | Stone | 273/384 |

FOREIGN PATENT DOCUMENTS

| | | | |
|---|---|---|---|
| 226386 | 12/1924 | United Kingdom | 273/384 |

*Primary Examiner*—Mark S. Graham

[57] ABSTRACT

A water dumping game with adjustable target comprising: a base with a front edge and a rear edge; an upright support having a front surface, a rear surface, an upper edge and a lower edge, the lower edge being affixed to the base, the upper edge including a recess formed therein; a seat with an upper end and a lower end, the lower end of the seat being positioned adjacent the front edge of the base; a bucket having an outer wall with two pins projecting therefrom, each pin being pivotally coupled within the recess of the upright support, the bucket being filled with water in an inoperative orientation; and a dumping assembly including at least one target and a bucket stabilizing device, in an inoperative orientation the bucket stabilizing device securing the bucket in an upright position, in an operative orientation the bucket stabilizing device permitting downward rotation of the bucket thereby dumping water on an individual positioned upon the seat of the apparatus, each target being operatively coupled to the bucket stabilizing device whereby upon striking of a target by a projectile the bucket stabilizing device being forced into an operative orientation.

5 Claims, 3 Drawing Sheets

WATER DUMPING GAME WITH ADJUSTABLE TARGET

BACKGROUND OF THE INVENTION

1. Field of the Invention

The present invention relates to a water dumping game with adjustable target and more particularly pertains to dumping a bucket of water onto a seated player by striking a target with a projectile.

2. Description of the Prior Art

The use of water games is known in the prior art. More specifically, water games heretofore devised and utilized for the purpose of entertaining users are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,093,228 to Pierce discloses a water dumping target game.

U.S. Pat. No. 3,970,310 to Gryschuk discloses a electrical targets irregularly illuminated.

U.S. Pat. No. 4,446,616 to Griego et al. discloses a target apparatus.

U.S. Pat. No. 4,702,480 to Popeski et al. discloses a flushing booth target apparatus.

U.S. Pat. No. 2,874,967 to Thereau et al. discloses a water target.

U.S. Pat. No. 2,148,438 to Crain et al. discloses a target.

U.S. Pat. No. 4,943,064 to Smith, Jr. discloses a dunk tank seat release mechanism.

U.S. Pat. No. 5,087,054 to O'Neil discloses an amusement dunking apparatus.

While these devices fulfill their respective, particular objective and requirements, the aforementioned patents do not describe a water dumping game with adjustable target for dumping a bucket of water onto a seated player by striking a target with a projectile.

In this respect, the water dumping game with adjustable target according to the present invention substantially departs from the conventional concepts and designs of the prior art, and in doing so provides an apparatus primarily developed for the purpose of dumping a bucket of water onto a seated player by striking a target with a projectile.

Therefore, it can be appreciated that there exists a continuing need for new and improved water dumping game with adjustable target which can be used for dumping a bucket of water onto a seated player by striking a target with a projectile. In this regard, the present invention substantially fulfills this need.

SUMMARY OF THE INVENTION

In the view of the foregoing disadvantages inherent in the known types of water games now present in the prior art, the present invention provides an improved water dumping game with adjustable target. As such, the general purpose of the present invention, which will be described subsequently in greater detail, is to provide a new and improved water dumping game with adjustable target and method which has all the advantages of the prior art and none of the disadvantages.

To attain this, the present invention essentially comprises a new and improved water dumping game with adjustable target for use in association with a water source, mounting means and projectile, the apparatus comprising, in combination: a base fabricated of plastic and formed in a generally rectangular configuration with an upper surface, a lower surface, a front edge and a rear edge, the front edge including a centrally positioned semicircular shaped recess formed contiguously therewith; an upright support fabricated of plastic and formed in a generally rectangular configuration with a front surface, a rear surface, an upper edge and a lower edge, the lower edge being affixed to the base in a perpendicular orientation, the upper edge including a U-shaped recess formed therein; a seat fabricated of plastic and formed in a generally cylindrical configuration with an upper end and a lower end, the lower end of the seat being positioned within the semicircular recess of the base; a bucket fabricated of plastic and formed in a generally cylindrical configuration with an open top, a hollow interior and an outer wall, the outer wall having a front portion, a back portion and a central axis, the back portion of the bucket including a transparent water level gauge formed therein, two pins projecting from the back portion of the outer wall adjacent to the central axis, each pin having a free end pivotally coupled within the U-shaped recess of the upright support; a filling assembly including an upper hose, a lower hose and a water fill valve, the upper hose being formed in a J-shaped configuration, the upper hose being positioned over the open top of the bucket and coupled to the upright support by two clips, the water fill valve being formed in a generally cylindrical configuration with a first end coupled to the upper hose, a second end coupled to the lower hose and an on/off switch positioned therebetween, in an operative orientation a user coupling the lower hose to a water source, the user then turning the valve to an on position thereby permitting filling of the interior of the bucket with water; and a dumping assembly including a remote target pad, a battery and a solenoid, the remote target pad, battery and solenoid being electrically coupled by an insulated wire, the dumping assembly further including a stabilizing rod, a battery box, a manual target and a bracket, the stabilizing rod having an upper end, a lower end and a center point, the remote target pad including a hanger to permit coupling to mounting means, the battery being positioned within the battery box and affixed to the rear surface of the upright support, the solenoid being affixed to the rear surface of the upright support and including a piston projecting therefrom, the piston being coupled to the lower end of the stabilizing rod, the manual target being affixed to the stabilizing rod above the lower end, the bracket having opposing ears and being coupled to the rear surface of the upright support, an axle being rotatably coupled between the opposing ears, the axle being coupled to the stabilizing rod adjacent its center point, in an inoperative orientation the upper end of the stabilizing rod being positioned adjacent the back portion of the outer wall to secure the bucket in a vertical position, in a first operative orientation a user hitting the remote target thereby activating the solenoid and causing the piston to retract, this action pulling the lower end of the stabilizing rod inward and pivoting the upper end of the stabilizing rod outward away from the bucket, the bucket rotating about the pins and dumping water on a player positioned on the seat.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved water dumping game with adjustable target which has all the advantages of the prior art water games and none of the disadvantages.

It is another object of the present invention to provide a new and improved water dumping game with adjustable target which may be easily and efficiently manufactured and marketed.

It is a further object of the present invention to provide a new and improved water dumping game with adjustable target which is of durable and reliable construction.

An even further object of the present invention is to provide a new and improved water dumping game with adjustable target which is susceptible of a low cost of manufacture with regard to both materials and labor, and which accordingly is then susceptible of low prices of sale to the consuming public, thereby making such a water dumping game with adjustable target economically available to the buying public.

Still yet another object of the present invention is to provide a new and improved water dumping game with adjustable target which provides in the apparatuses and methods of the prior art some of the advantages thereof, while simultaneously overcoming some of the disadvantages normally associated therewith.

Even still another object of the present invention is to provide a new and improved water dumping game with adjustable target for dumping a bucket of water onto a seated player by striking a target with a projectile.

Lastly, it is an object of the present invention to provide a new and improved water dumping game with adjustable target comprising: a base with a front edge and a rear edge; an upright support having a front surface, a rear surface, an upper edge and a lower edge, the lower edge being affixed to the base, the upper edge including a recess formed therein; a seat with an upper end and a lower end, the lower end of the seat being positioned adjacent the front edge of the base; a bucket having an outer wall with two pins projecting therefrom, each pin being pivotally coupled within the recess of the upright support, the bucket being filled with water in an inoperative orientation; and a dumping assembly including at least one target and a bucket stabilizing device, in an inoperative orientation the bucket stabilizing device securing the bucket in an upright position, in an operative orientation the bucket stabilizing device permitting downward rotation of the bucket thereby dumping water on an individual positioned upon the seat of the apparatus, each target being operatively coupled to the bucket stabilizing device whereby upon striking of a target by a projectile the bucket stabilizing device being forced into an operative orientation.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
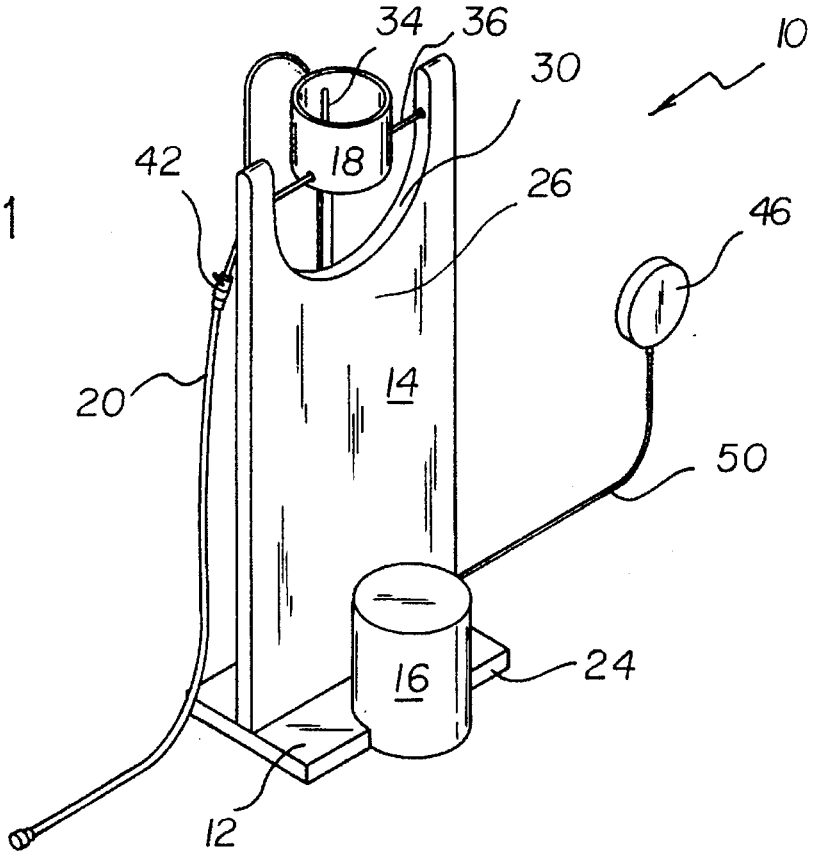
FIG. 1 is a perspective view of the preferred embodiment of the water dumping game with adjustable target constructed in accordance with the principles of the present invention.

With reference now to the drawings, and in particular, to FIG. 1 thereof, the preferred embodiment of the new and improved water dumping game with adjustable target embodying the principles and concepts of the present invention and generally designated by the reference number 10 will be described.

Specifically, it will be noted in the various Figures that the device relates to a water dumping game with adjustable target 10. In its broadest context, the device consists of a base 12, an upright support 14, a seat 16, a bucket 18, a filling assembly 20 and a dumping assembly 22. Such components are individually configured and correlated with respect to each other so as to attain the desired objective.

The new and improved water dumping game with adjustable target is intended for use in association with a water source, mounting means and projectile. In the preferred embodiment of the apparatus a garden hose is connected to the lower end of the lower hose to permit access to a residential water supply. Various items such as a garage door, a fence or the side of a house could be used to mount the apparatus. In the preferred embodiment of the apparatus the projectile is a rubber ball. Alternatively, a sponge ball or water balloon could be used as a projectile.

Figure 3:
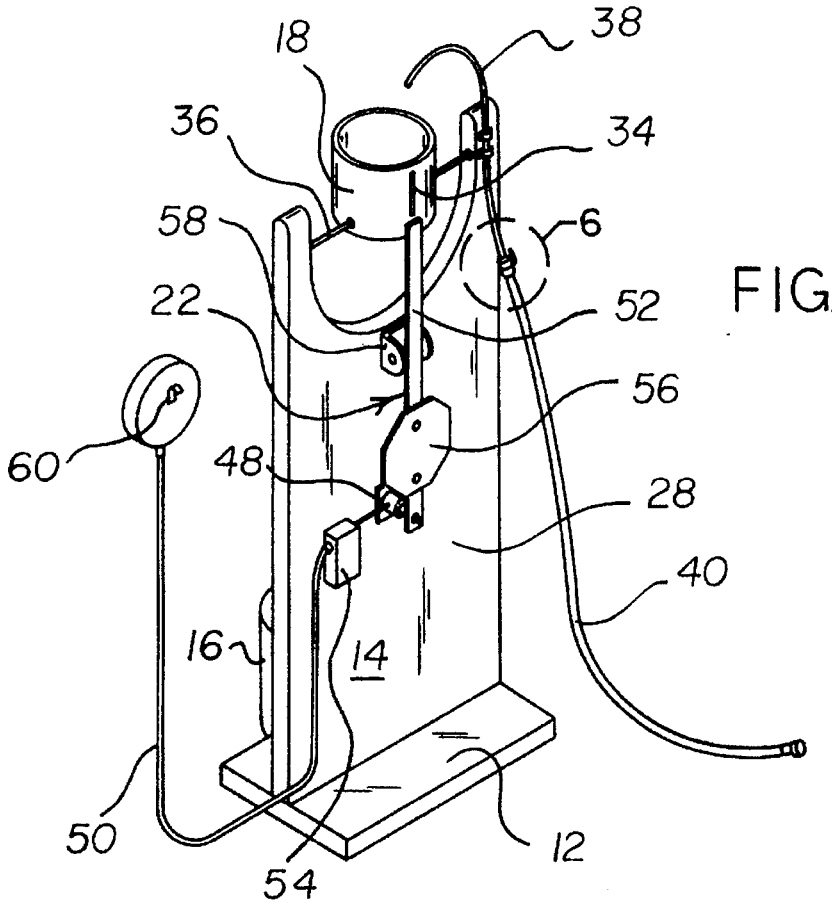
FIG. 3 is a back perspective view of the apparatus illustrating the manual target.
Figure 4:
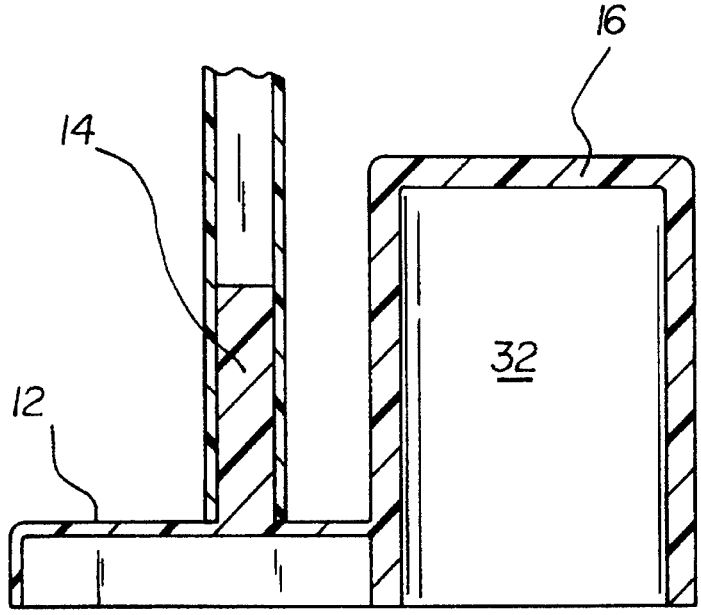
FIG. 4 is a cross sectional view of the apparatus illustrating the seat.

The base 12 is fabricated of plastic and formed in a generally rectangular configuration with an upper surface, a lower surface, a front edge 24 and a rear edge. The front edge includes a centrally positioned semicircular shaped recess formed contiguously within it. The recess provides the necessary clearance area for the cylindrical seat of the apparatus. The seat 16 is positioned below the bucket 18 so that water is dumped onto the head of the seated participant when the target is struck. Weights may be utilized to stabilize the base during use. The base has a width of about twenty two inches and a depth of about sixteen inches. Note FIGS. 1, 3 and 4.

The upright support 14 is fabricated of plastic and formed in a generally rectangular configuration with a front surface 26, a rear surface 28, an upper edge and a lower edge. The lower edge is affixed to the base in a perpendicular orientation. The upper edge includes a U-shaped recess 30 formed within it. The upright support has a width of about twenty two inches and a height of about sixty inches. Note FIG. 3.

The seat 16 is fabricated of plastic and formed in a generally cylindrical configuration with an upper end and a lower end. The lower end of the seat is positioned within the semicircular recess of the base. The seat has a hollow interior 32 to facilitate transport. In alternate embodiments of the apparatus the seat is formed contiguously with the base. Note FIG. 1.

Figure 2:
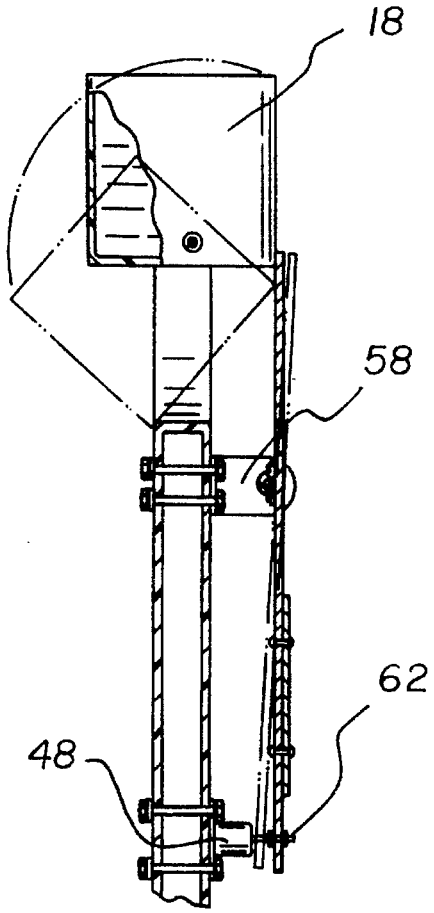
FIG. 2 is a side perspective view of the apparatus illustrating the movement of the stabilizing rod and the bucket.
Figure 5:
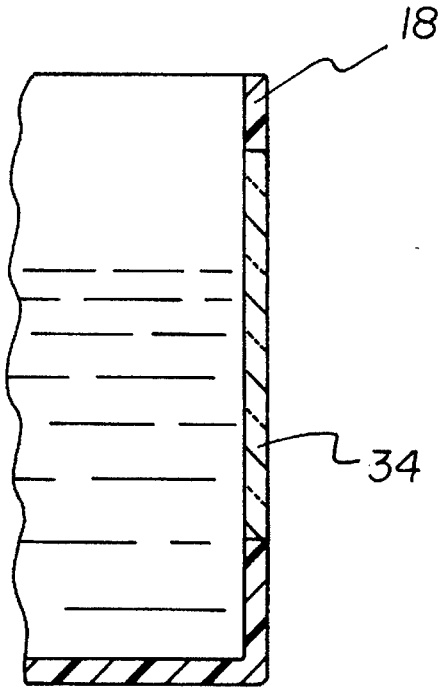
FIG. 5 is a cross sectional view of the bucket illustrating the water level gauge.

The bucket 18 is fabricated of plastic and formed in a generally cylindrical configuration with an open top, a hollow interior and an outer wall. The outer wall has a front portion, a back portion and a central axis. The back portion of the bucket includes a transparent water level gauge 34 formed within it. The gauge allows a user to easily ascertain the amount of water in the bucket. This is particularly useful during refilling of the bucket. Two pins 36 project from the back portion of the outer wall of the bucket adjacent to its central axis. Each pin has a free end which is pivotally coupled within the U-shaped recess of the upright support. The off center placement of the pins 36 urges the bucket in a forward direction when filled with water due to the uneven weight distribution will be explained in more detail below, the stabilizing rod prevents forward rotation of a full bucket in the inoperative orientation. Note FIGS. 2, 3 and 5.

Figure 6:
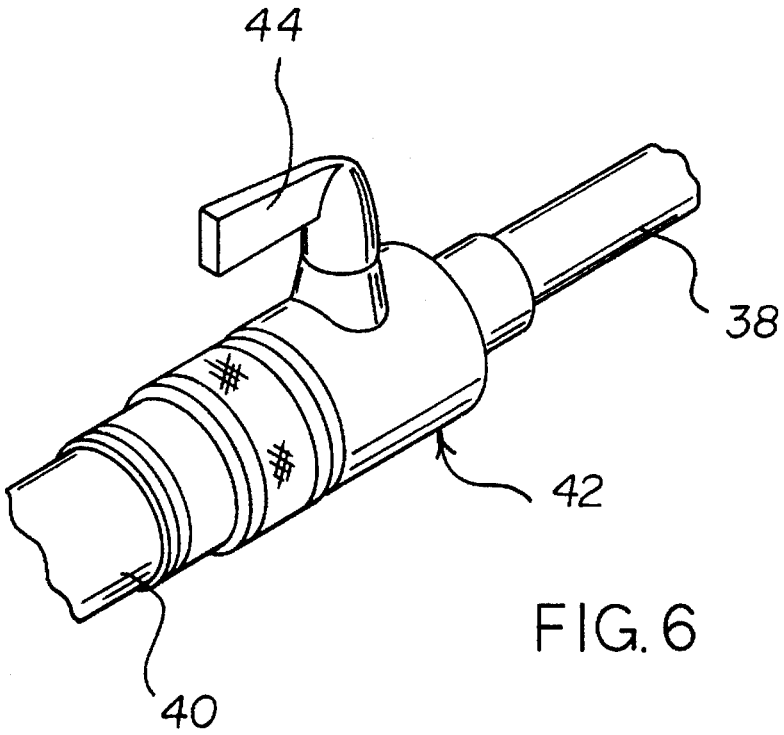
FIG. 6 is an enlarged perspective view of the water fill valve of the apparatus.

The filling assembly 20 includes an upper hose 38, a lower hose 40 and a water fill valve 42. The upper hose is formed in a J-shaped configuration. The upper hose is positioned over the open top of the bucket 16 and coupled to the upright support by two clips. The water fill valve 42 is formed in a generally cylindrical configuration with a first end coupled to the upper hose 38. A second end of the water fill valve is coupled to the lower hose 40. An on/off switch 44 is positioned between the fist and second ends and permits the user to regulate water flow when the bucket requires refilling. In an operative orientation a user couples the lower hose to a water source, such as a garden hose connected to a residential water supply system. The user then turns the valve to an on position thereby permitting filling of the interior of the bucket with water. Note FIGS. 3 and 6.

The dumping assembly 22 includes a remote target pad 46, a battery and a solenoid 48. The remote target pad, battery and solenoid are electrically coupled by an insulated copper wire 50. The dumping assembly further includes a stabilizing rod 52, a battery box 54, a manual target 56 and a bracket 58. The stabilizing rod has an upper end, a lower end and a center point. The remote target pad includes a hanger 60 to permit coupling to mounting means such as a garage door, tree, fence, swing set, etc. The battery is within the battery box 54 to protect is from water damage. The battery box is affixed to the rear surface of the upright support. The solenoid is affixed to the rear surface of the upright support and includes a piston 62 projecting from it. The piston is coupled to the lower end of the stabilizing rod. The manual target 56 is affixed to the stabilizing rod above its lower end. Note FIGS. 1 and 2.

The bracket 58 has opposing ears and is coupled to the rear surface of the upright support. An axle is rotatably coupled between the opposing ears. The axle is affixed to the stabilizing rod adjacent its center point. In an inoperative orientation the upper end of the stabilizing rod 52 is positioned adjacent the back portion of the outer wall to secure the bucket 18 in a vertical position. In a first operative orientation a user hits the remote target with a projectile, thereby activating the solenoid 48 and causing the piston to retract. This action pulls the lower end of the stabilizing rod inward and pivots the upper end of the stabilizing rod outward away from the bucket. The bucket rotates about the pins 36 and dumps water on a player positioned on the seat. Note FIGS. 1 and 3.

In a second operative orientation a player throws a projectile at the manual target 56. Upon striking of the manual target it moves in an inward direction causing pivotal movement of the stabilizing rod about the axle. This allows the bucket to rotate thereby dumping water on a player positioned on the seat. The advantage of using the remote target 46 is that the players can see each other's reactions upon striking of the remote target. The advantage of the manual target 56 is that the game may still be played if the batteries become inoperable. Additionally, the seated player is protected from the incoming projectile. Note FIGS. 1 and 3.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A new and improved water dumping game with adjustable target for use in association with a water source, mounting means and projectile, the apparatus comprising, in combination:

a base fabricated of plastic and formed in a generally rectangular configuration with an upper surface, a lower surface, a front edge and a rear edge, the front edge including a centrally positioned semicircular shaped recess formed contiguously therewith;

an upright support fabricated of plastic and formed in a generally rectangular configuration with a front surface, a rear surface, an upper edge and a lower edge, the lower edge being affixed to the base in a perpendicular orientation, the upper edge including a U-shaped recess formed therein;

a seat fabricated of plastic and formed in a generally cylindrical configuration with an upper end and a lower end, the lower end of the seat being positioned within the semicircular recess of the base;

a bucket fabricated of plastic and formed in a generally cylindrical configuration with an open top, a hollow interior and an outer wall, the outer wall having a front portion, a back portion and a central axis, the back portion of the bucket including a transparent water level gauge formed therein, two pins projecting from the back portion of the outer wall adjacent to the central axis, each pin having a free end pivotally coupled within the U-shaped recess of the upright support;

a filling assembly including an upper hose, a lower hose and a water fill valve, the upper hose being formed in a J-shaped configuration, the upper hose being positioned over the open top of the bucket and coupled to the upright support by two clips, the water fill valve being formed in a generally cylindrical configuration with a first end coupled to the upper hose, a second end coupled to the lower hose and an on/off switch positioned therebetween, in an operative orientation a user coupling the lower hose to a water source, the user then turning the valve to an on position thereby permitting filling of the interior of the bucket with water; and a dumping assembly including a remote target pad, a battery and a solenoid, the remote target pad, battery and solenoid being electrically coupled by an insulated wire, the dumping assembly further including a stabilizing rod, a battery box, a manual target and a bracket, the stabilizing rod having an upper end, a lower end and a center point, the remote target pad including a hanger to permit coupling to mounting means, the battery being positioned within the battery box and affixed to the rear surface of the upright support, the solenoid being affixed to the rear surface of the upright support and including a piston projecting therefrom, the piston being coupled to the lower end of the stabilizing rod, the manual target being affixed to the stabilizing rod above the lower end, the bracket having opposing ears and being coupled to the rear surface of the upright support, an axle being rotatably coupled between the opposing ears, the axle being coupled to the stabilizing rod adjacent its center point, in an inoperative orientation the upper end of the stabilizing rod being positioned adjacent the back portion of the outer wall to secure the bucket in a vertical position, in a first operative orientation a user hitting the remote target thereby activating the solenoid and causing the piston to retract, this action pulling the lower end of the stabilizing rod inward and pivoting the upper end of the stabilizing rod outward away from the bucket, the bucket rotating about the pins and dumping water on a player positioned on the seat.

2. A water dumping game with adjustable target comprising:

a base with a front edge and a rear edge; an upright support having a front surface, a rear surface, an upper edge and a lower edge, the lower edge being affixed to the base, the upper edge including a recess formed therein; a seat with an upper end and a lower end, the lower end of the seat being positioned adjacent the front edge of the base; a bucket having an outer wall with two pins projecting therefrom, each pin being pivotally coupled within the recess of the upright support, the bucket including a back portion having a transparent water level gauge formed therein, the bucket being filled with water in an inoperative orientation;

a dumping assembly including at least one target and a bucket stabilizing device, in an inoperative orientation the bucket stabilizing device securing the bucket in an upright position, in an operative orientation the bucket stabilizing device permitting downward rotation of the bucket thereby dumping water on an individual positioned upon the seat of the apparatus, each target being operatively coupled to the bucket stabilizing device whereby upon striking of a target by a projectile the bucket stabilizing device being forced into an operative orientation; and a filling assembly including an upper hose, a lower hose and a water fill valve, the upper hose being formed in a J-shaped configuration, the upper hose being positioned over the bucket and coupled to the upright support by two clips, the water fill valve being formed in a generally cylindrical configuration with a first end coupled to the upper hose, a second end coupled to the lower hose and an on/off switch positioned therebetween, in an operative orientation a user coupling the lower hose to a water source, the user then turning the valve to an on position thereby permitting filling of the interior of the bucket with water.

3. A water dumping game with adjustable target comprising:

a base with a front edge and a rear edge; an upright support having a front surface, a rear surface, an upper edge and a lower edge, the lower edge being affixed to the base, the upper edge including a recess formed therein; a seat with an upper end and a lower end, the lower end of the seat being positioned adjacent the front edge of the base; a bucket having an outer wall with two pins projecting therefrom, each pin being pivotally coupled within the recess of the upright support, the bucket being filled with water in an operative orientation, the bucket including a stabilizing device comprising a stabilizing rod and a bracket, the stabilizing rod having an upper end, a lower end and a center point, the lower end of the stabilizing rod being coupled to the rear surface of the upright support by a piston, the piston being operatively coupled to the target, the bracket having opposing ears and being coupled to the rear surface of the upright support, an axle being rotatably coupled between the opposing ears, the axle being coupled to the stabilizing rod adjacent its center point, in an operative orientation the upper end of the stabilizing rod being positioned adjacent the outer wall to secure the bucket in a vertical position, in an operative orientation a user hitting the target thereby causing the piston to retract, this action pulling the lower end of the stabilizing rod inward and pivoting the upper end of the stabilizing rod outward away from the bucket, the bucket rotating about the pins and dumping water on a player positioned on the seat; and a dumping assembly including the target and the bucket stabilizing device, in an inoperative orientation the bucket stabilizing device securing the bucket in an upright position, in an operative orientation the bucket stabilizing device permitting downward rotation of the bucket thereby dumping water on an individual positioned upon the seat of the apparatus, the target being operatively coupled to the bucket stabilizing device whereby upon striking of the target by a projectile the bucket stabilizing device being forced into an operative orientation.

4. The water dumping game with adjustable target as set forth in claim 3 wherein a remote target pad is included with the apparatus, the remote target pad including a battery and a solenoid and being electrically coupled by an insulated wire, the solenoid being electrically coupled to the piston.

5. The water dumping game with adjustable target as set forth in claim 3 wherein a manual target pad is included with the apparatus, the manual target pad being affixed to the stabilizing rod between the bracket and piston.

* * * * *